US007792450B2

(12) United States Patent
Takagi et al.

(10) Patent No.: US 7,792,450 B2
(45) Date of Patent: Sep. 7, 2010

(54) FIXING DEVICE FOR IMAGE FORMING APPARATUS AND CONTROL METHOD THEREOF

(75) Inventors: Osamu Takagi, Chofu (JP); Satoshi Kinouchi, Shinjuku-ku (JP); Yoshinori Tsueda, Fuji (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 531 days.

(21) Appl. No.: 11/736,080

(22) Filed: Apr. 17, 2007

(65) Prior Publication Data

US 2008/0260407 A1 Oct. 23, 2008

(51) Int. Cl.
*G03G 15/20* (2006.01)

(52) U.S. Cl. ..... 399/69

(58) Field of Classification Search ..... 399/69, 399/67; 219/216, 469–471
See application file for complete search history.

(56) References Cited

U.S. PATENT DOCUMENTS 7,196,286 B2 * 3/2007 Kishi et al. ..... 219/216
7,421,224 B2 * 9/2008 Kishi et al. ..... 399/69
2002/0043523 A1 * 4/2002 Fujita et al. ..... 219/216
2004/0042825 A1 * 3/2004 Yasui et al.
2004/0131374 A1 * 7/2004 Sakai ..... 399/69
2005/0189923 A1 * 9/2005 Ohishi et al.
2007/0047989 A1 * 3/2007 Nakamura et al. ..... 399/67
2007/0059017 A1 * 3/2007 Omura
2007/0088963 A1 * 4/2007 Nakaya
2008/0181641 A1 * 7/2008 Mori ..... 399/69
2008/0260408 A1 * 10/2008 Takagi et al. ..... 399/69
2009/0074442 A1 * 3/2009 Sano et al. ..... 399/69

FOREIGN PATENT DOCUMENTS

JP 2002132088 A * 5/2002
JP 2002221871 A * 8/2002

* cited by examiner

*Primary Examiner*—Susan S Lee
(74) *Attorney, Agent, or Firm*—Turocy & Watson, LLP

(57) ABSTRACT

A fixing device of this invention enables variable control of power to be supplied to a heat roller side or a press roller side in accordance with the temperature of the heat roller and the press roller while each mode is carried out. A secondary battery is used in addition to a commercial power source, thus enabling supply of power to the heat roller side or the press roller side. The secondary battery is used when necessary, thus increasing the power supply. In a copy mode, the temperature of the heat roller and the press roller is controlled in detail. In a non-copy state, the power supply to the fixing device is stopped.

17 Claims, 5 Drawing Sheets

FIXING DEVICE FOR IMAGE FORMING APPARATUS AND CONTROL METHOD THEREOF

BACKGROUND OF THE INVENTION

1. Field of the Invention

The present invention relates to a fixing device in an image forming apparatus for fixing onto a sheet paper, by heating and pressurizing, a toner image formed in the image forming apparatus using an electro photographic process such as a copy machine, printer or facsimile, and a control method thereof.

2. Description of the Background

As a fixing device incorporated in an image forming apparatus using an electro photographic process such as a copy machine, printer or facsimile, there is a fixing device that fixes a toner image on a sheet paper by heating and pressurizing. In such a fixing device, a sheet paper is inserted between a pair of rollers including a heat roller and a press roller, or in a nipping part formed between similar belts, and a toner image is fixed thereon by being heated and pressurized. Meanwhile, a full-color toner image formed by superimposed toner images of plural colors has a toner layer thickness that is several times larger than that of a monochrome toner image.

Therefore, when the temperature of the heat roller is raised to melt the thick toner layer, only the surface of the toner layer melts excessively. If only the surface of the toner layer melts excessively, a high-temperature offset may occur. Moreover, for a color image, a difference in the way of melting of the toner layer causes a color difference in the fixed image and predetermined image quality cannot be acquired. That is, it is necessary to evenly melt the color toner layer and to prevent a color difference.

Thus, in a conventional, as a color image fixing device, there is a device that has a heating source both in a heat roller and a press roller, and heats both the heat roller and the press roller. This conventional fixing device can evenly melt a toner layer by heating the toner layer from both above and below. Also, the conventional fixing device can prevent a high-temperature offset of the toner.

However, also in such a conventional fixing device, heating control of the heat roller and the press roller is only on-off control of the heating source by application of predetermined power for each operation mode. Therefore, the heat roller and the press roller tend to have a temperature ripple and this temperature ripple may cause a color difference in the fixed image.

Meanwhile, high-speed warming-up is demanded in the fixing device in order to improve convenience for the user. However, if the total electrical quantity of a commercial power source that can be used in the entire color image forming apparatus can be 1500 W or less, no special installation work is necessary even in markets all over the world. Therefore, the electrical quantity that can be actually used for the heating source of the fixing device is the electrical quantity that remains after subtracting the electrical quantity used for a driving source such as a motor and the electrical quantity used for optional functions such as a finisher from 1500 W, and realization of high-speed warming-up is limited.

On the other hand, if the fixing device is pre-heated in the copy standby state to realize high-speed warming-up, power is consumed also in the copy standby state and energy saving in the image forming apparatus is hindered. Moreover, in the conventional fixing device, in which both the heat roller and the press roller have a heating source, the power consumption in the standby state may increase further.

Thus, in fixing a color toner image with a thick toner layer, by evenly melting the toner layer, it is possible to provide uniform image quality without generating a color difference in the fixed image. Moreover, a control method of the fixing device in the image forming apparatus is desired which enables energy saving without losing the convenience for the user.

SUMMARY OF THE INVENTION

Thus, according to an aspect of the invention, as the toner layer of a color toner image with the thick toner layer is heated from above and below, the toner layer is evenly melted and a color difference is prevented, thus providing a stable fixed image. Moreover, a fixing device for an image forming apparatus and a control method thereof are provided which are not lose the convenience for the user by making the user wait long for a fixing operation, and enable reduction of power consumption while fixation is not carried out and hence energy saving.

To achieve the above advantage, an aspect of the invention includes an image-side rotating member, a non-image-side rotating member configured to nip and carry a fixing target medium having a toner image thereon into a predetermined direction together with the image-side rotating member, a first heating source configured to heat the image-side rotating member, a second heating source configured to heat the non-image-side rotating member, a commercial power source configured to be capable of supplying power to the first heating source and the second heating source, an auxiliary power source configured to be capable of supplying power at least to the second heating source, and a control unit configured to variably control power to be supplied to the first heating source or the second heating source from the commercial power source and/or the auxiliary power source while the image-side rotating member is carrying out an arbitrary operation mode.

DETAILED DESCRIPTION OF THE INVENTION

Figure 1:
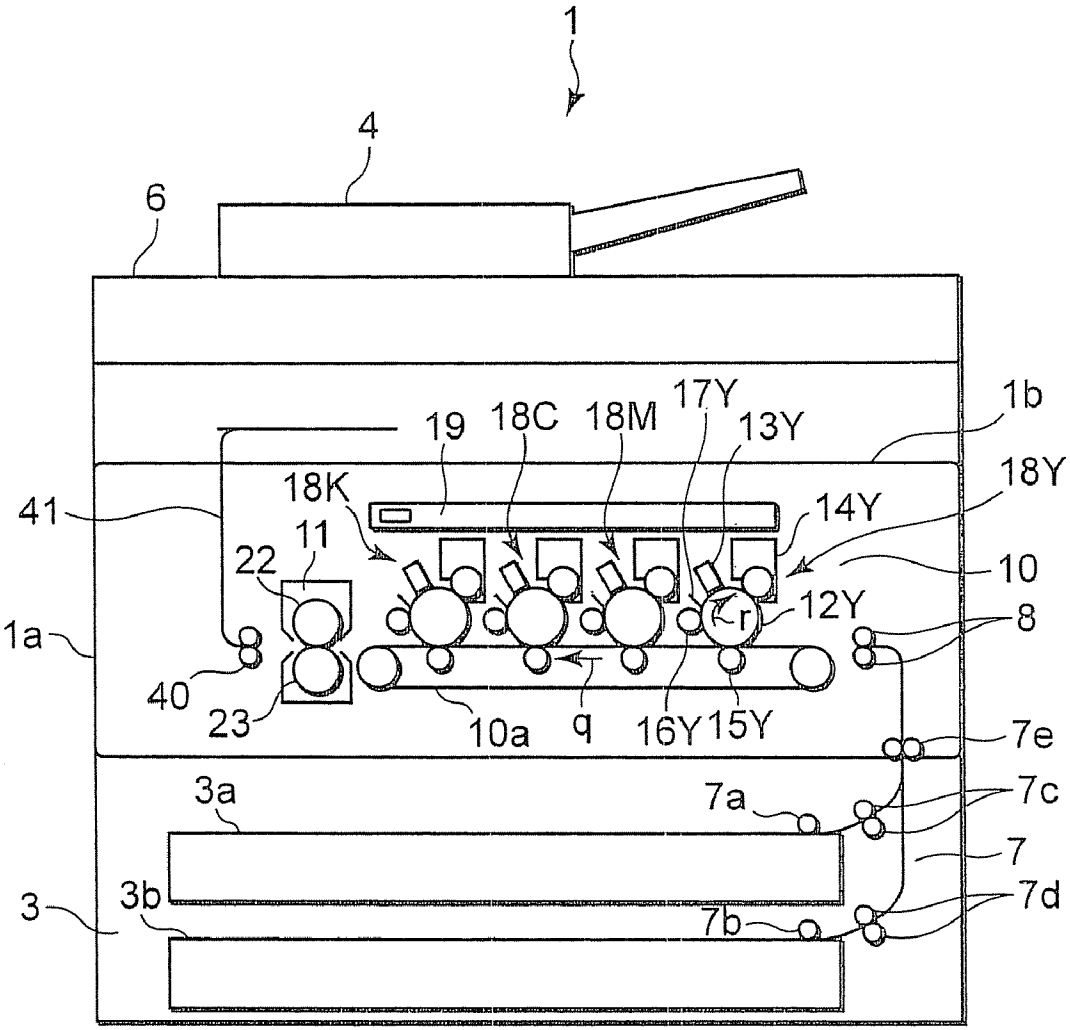
FIG. 1 is schematic configuration view showing an image forming apparatus equipped with a fixing device according to a first embodiment of the invention.

Hereinafter, a first embodiment of the invention will be described in detail with reference to the accompanying drawings. FIG. 1 is a schematic configuration view showing a color image forming apparatus 1 according to an embodiment of the invention. A scanner unit 6 that reads an original supplied by an automatic document feeder 4 is provided at the top of the color image forming apparatus 1. The color image forming apparatus 1 has a cassette mechanism 3 that supplies a sheet paper P, which is a fixing target medium, to an image forming unit 10.

The cassette mechanism 3 has first and second paper feed cassettes 3*a* and 3*b*. In a carrier path 7 from the paper feed cassettes 3*a*, 3*b* to the image forming unit 10, pickup rollers 7*a*, 7*b* that take out a sheet paper from the paper feed cassettes 3*a*, 3*b*, separation carrier rollers 7*c*, 7*d*, carrier rollers 7*e*, and resist rollers 8 are provided. A fixing device 11 that fixes a toner image that is formed on the sheet paper P by the image forming unit 10 is provided downstream of the image forming unit 10. Paper eject rollers 40 are provided downstream of the fixing device 11, and a paper eject carrier path 41 that carries the sheet paper P after the fixation to a paper eject portion 1*b* is provided.

The image forming unit 10 has image forming stations 18Y, 18M, 18C and 18K for the colors of yellow (Y), magenta (M), cyan (C) and black (K). The image forming stations 18Y, 18M, 18C and 18K are arrayed in tandem along a transfer belt 10*a* turned in the direction of an arrow q.

The yellow (Y) image forming station 18Y is configured with a charger 13Y, a developing device 14Y, a transfer roller 15Y, a cleaner 16Y and an electricity eliminator 17Y, which are process members, arranged around a photoconductive drum 12Y, which is an image carrier rotating in the direction of an arrow r. Also, a laser exposure device 19 that casts a laser beam to the photoconductive drum 12Y is provided above the yellow (Y) image forming station 18Y.

The magenta (M), cyan (C) and black (K) image forming stations 18M, 18C and 18K have a configuration similar to that of the yellow (Y) image forming station 18Y.

In the yellow (Y) image forming station 18Y, the photoconductive drum 12Y, and the charger 13Y, the developing device 14Y, the cleaner 16Y and the electricity eliminator 17Y around the photoconductive drum, form a process cartridge, and it is integrally attachable to and removable from a body 1*a*. The configuration of the process cartridge is not limited, as long as at least one of the charger, the developing unit and the cleaner, and the photoconductive drum are integrally supported and attachable to and removable from the body of the image forming apparatus. It can be an arbitrary configuration, for example, a process cartridge in which only a developing unit and a cleaner are integrally provided around a photoconductive drum, and which is integrally attachable to and removable from the body of the image forming apparatus.

As a print operation is started in the image forming unit 10, in the yellow (Y) image forming station 18Y, the photoconductive drum 12Y rotates in the direction of the arrow r and is uniformly charged by the charger 13Y. Then, the photoconductive drum 12Y is irradiated by the laser exposure device 19 with exposure light corresponding to image information read by the scanner unit 6, and an electrostatic latent image is formed thereon. After that, a toner image is formed on the photoconductive drum 12Y by the developing device 14Y, and at the position of the transfer roller 15Y, the toner image is transferred onto the sheet paper P carried in the direction of the arrow q by the transfer belt 10*a*. After the end of the transfer, the photoconductive drum 12Y is cleaned by the cleaner 16Y to remove the remaining toner, and the electricity on the surface of the photoconductive drum 12Y is eliminated by the electricity eliminator 17Y. Thus, the next printing is available.

The magenta (M), cyan (C) and black (K) image forming stations 18M, 18C and 18K carry out the image forming operation similarly to the yellow (Y) image forming station 18Y, and form a full-color toner image on the sheet paper P. After that, fixation by heating and pressurizing is carried out on the sheet paper P by the fixing device 11, which is an induction heating fixing device. The print image is completed and the sheet paper is ejected to the paper eject portion 1*b*.

Figure 2:
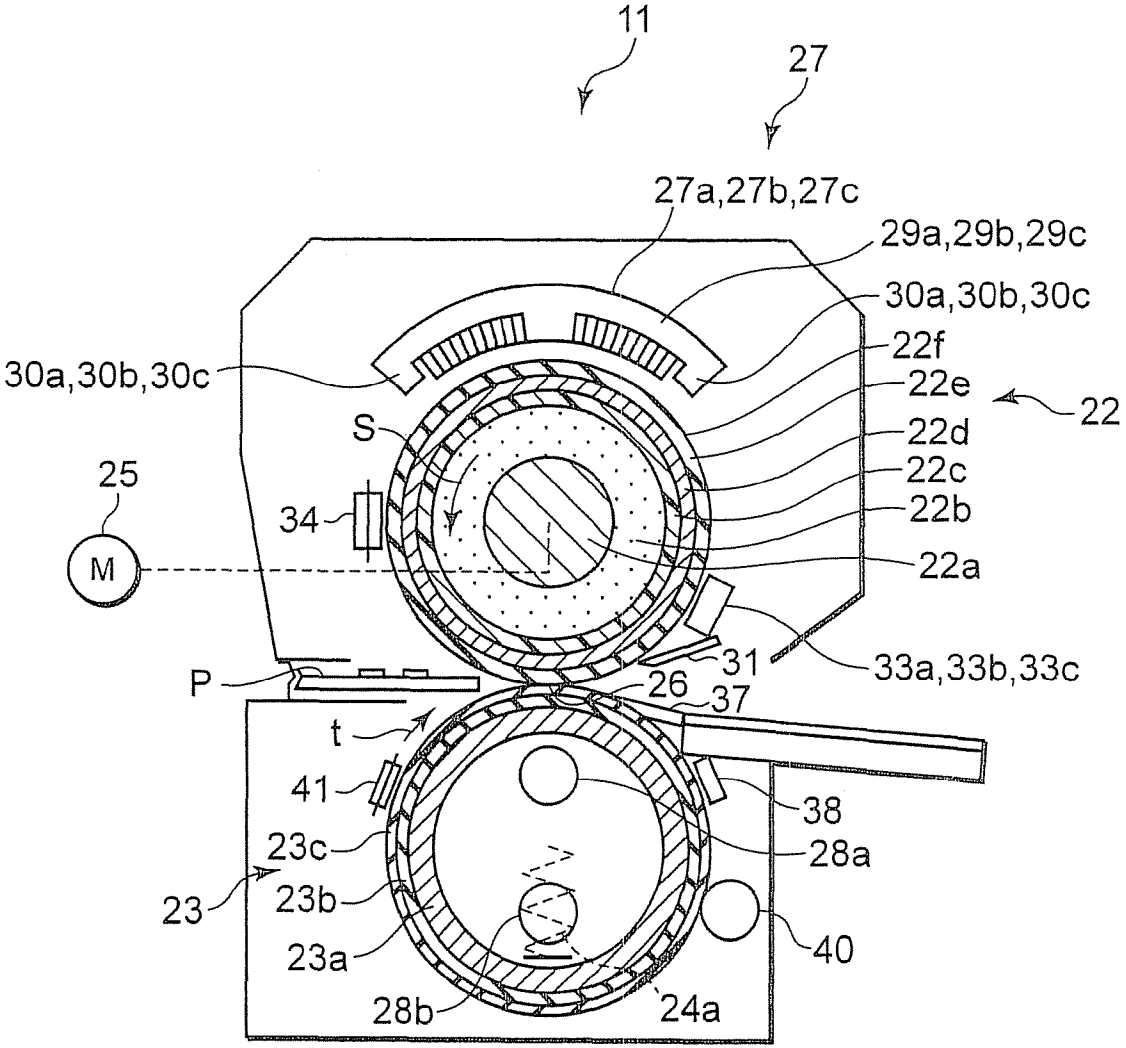
FIG. 2 is a schematic configuration view showing the fixing device according to the first embodiment of the invention.
Figure 3:
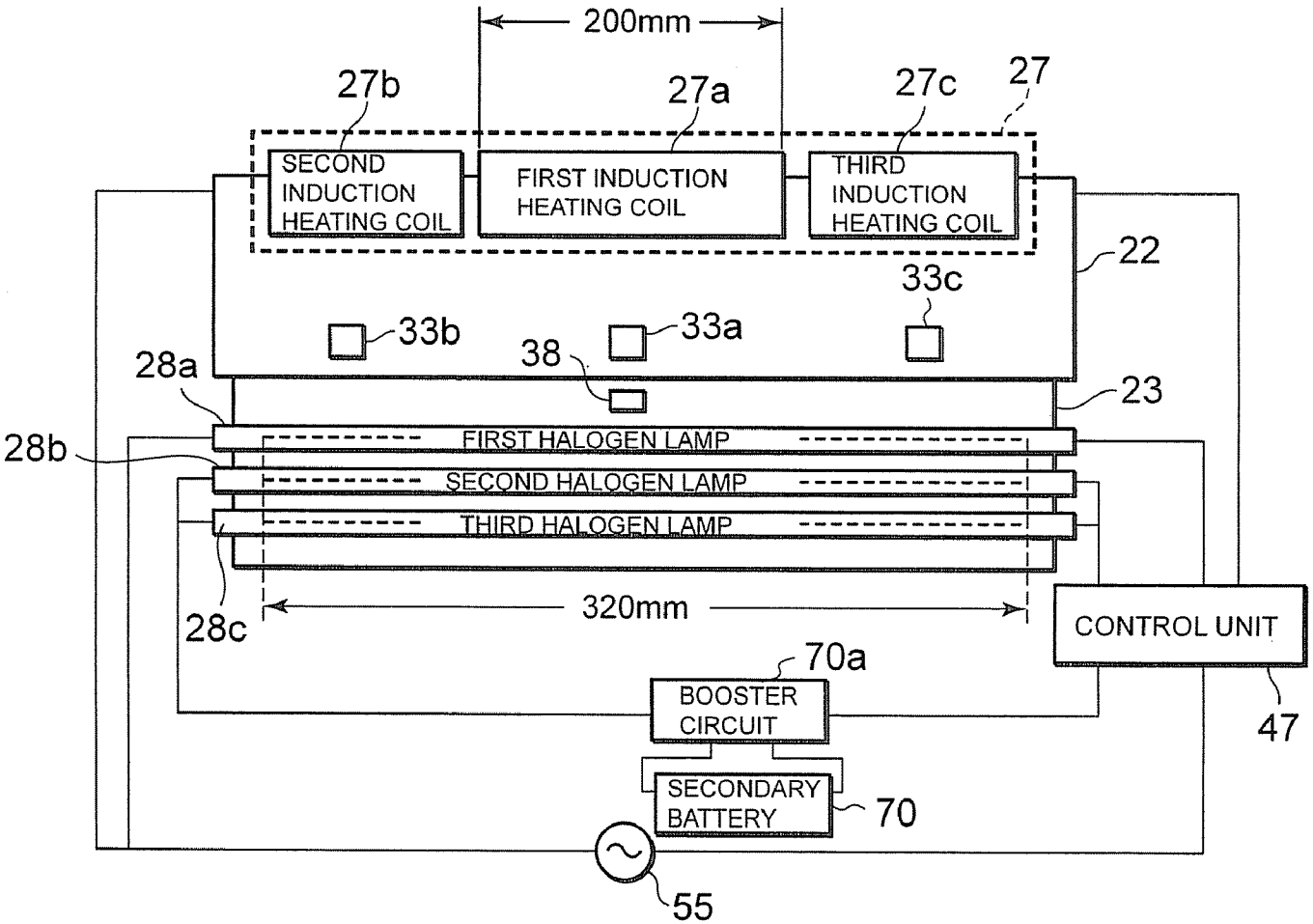
FIG. 3 is an explanatory view showing the fixing device according to the first embodiment of the invention, as viewed from its lateral side.

Next, the fixing device 11 will be described. FIG. 2 is a schematic configuration view showing the fixing device 11. FIG. 3 is an explanatory view of the fixing device 11 as viewed from its lateral side. The fixing device 11 has a heat roller 22 with a diameter of 40 mm, which is an image-side rotating member, and a press roller 23 with a diameter of 40 mm, which is a non-image-side rotating member. The heat roller 22 is driven in the direction of an arrow s by a driving motor 25. The press roller 23 is pressed in contact with the heat roller 22 by a pressurizing spring 24*a*. Thus, a nipping part 26 with a predetermined width is formed between the heat roller 22 and the press roller 23. The press roller 23 follows the heat roller 22 and rotates in the direction of an arrow t.

The heat roller 22 includes, around a core metal 22*a*, a foam rubber (sponge) 22*b* made of silicone rubber including independent bubbles or continuous bubbles, a heat-resistant resin layer 22*c*, a metal conductive layer 22*d* with a thickness of 40 μm made of nickel (Ni), a solid rubber layer 22*e* with a thickness of 200 μm, and a separation layer 22*f* with a thickness of 30 μm. The metal conductive layer 22*d* is not limited to nickel and may be made of stainless steel, aluminum, or a composite material of stainless steel and aluminum, and the like.

The press roller 23 is configured with a hollow core metal 23*a* coated with, for example, a 0.5-mm thick silicone rubber layer 23*b* and a fluorinated rubber layer 23*c*. As the sheet paper P passes through the nipping part 26 between such heat roller 22 and press roller 23, the toner image on the sheet paper P is fixed by heating and pressurizing. The thickness of the silicone rubber layer 23*b* of the press roller 23 is not limited, but it is preferred that its thickness is as thin as 0.2 to 3 mm so that the temperature difference between the inner side and the outer side of the silicone rubber layer 23*b* is small, in consideration of the thermal conductivity in the case where a heat source is provided in the hollow part of the core metal 23*a*.

In the fixing device 11, an induction heating coil 27, which is a first heating source to heat the heat roller 22, is provided via a gap of about 3 mm over the outer circumference of the heat roller 22. The induction heating coil 27 is substantially coaxial with the heat roller 22. Moreover, a stripping plate 31 supported with a gap of approximately 0.5 mm to the heat roller 22 in order to prevent the sheet paper P as a fixing target medium from being wound after the fixation, first to third thermistors 33*a* to 33*c* as first temperature detection members, and a thermostat 34 that detects anomaly in the surface temperature of the heat roller 22 and interrupts heating, are provided over the outer circumference of the heat roller 22. A stripping pawl may be provided instead of the stripping plate 31, and no stripping plate needs to be arranged if there is no risk of the sheet paper P being wound on the heat roller 22.

The press roller 23 has three halogen lamp heaters, that is, first to third halogen lamp heaters 28*a*, 28*b* and 28*c* as a second heating source in the hollow core metal 23*a*. All of the first to third halogen lamp heaters 28*a*, 28*b* and 28*c* have a length of 320 mm in the axial direction of the press roller 23, and each of them heats the fixing area of the press roller 23 across the total length. However, the power consumption of the first halogen lamp heater 28*a* is 300 W. The power consumption of the second halogen lamp heater 28*b* is 500 W. The power consumption of the third halogen lamp heater 28*c* is 1000 W.

The first halogen lamp heater 28*a* is supplied with power by a commercial power source 55. The second and third halogen lamp heaters 28*b* and 28*c* are supplied with power by a secondary battery 70, which is an auxiliary power source.

Thus, on the side of the press roller 23, it is set that maximum power of 1500 W can be supplied to the second and third halogen lamp heaters 28*b* and 28*c*. The secondary battery 70 charges power when the color image forming apparatus 1 is not working. The secondary battery 70 discharges the charged power when the power is insufficient as the color image forming apparatus 1 is driven. The secondary battery 70 supplies a direct current, and if its charging rate is 20% or more, it can supply power of 500 W for about 5 minutes or more.

Also, the voltage of the secondary battery 70 can be set at a low level if the voltage of the secondary battery 70 is raised to a required value by a booster circuit 70 such as a DC-DC converter. Alternatively, the voltage of the secondary battery 70 may be made alternate by an inverter while increase the voltage to a required voltage. Thus, power can also be supplied to the halogen lamp heaters 28 and the induction heating coil 27. Even when large power of 1500 W at the maximum is supplied to the second and third halogen lamp heaters 28*b* and 28*c*, in the press roller 23, the silicone rubber layer 23*b* is prevented from being heated beyond its heat resistance and thermally degraded, or from having its adhesive performance lowered and being damaged. This is because the thickness of the silicone rubber layer 23*b* is as thin as 0.5 to 3 mm and the outer temperature can heat the surface of the press roller 23 to a predetermined temperature before the inner side of the silicone rubber layer 23*b* exceeds the heat-resistance temperature.

Over the circumference of the press roller 23, a stripping pawl 37 to strip the sheet paper P from the press roller 23, a fourth thermistor 38 as a second temperature detection member that detects the surface temperature of the press roller, a cleaning member 40, and a thermostat 41 are provided along the rotating direction of the press roller 23. The fourth thermistor 38 detects the temperature of the press roller 23 heated by the first to third halogen lamp heaters 28*c*.

The induction heating coil 27 includes first to third induction heating coils 27*a*, 27*b* and 27*c*. The first to third induction heating coils 27*a*, 27*b* and 27*c* are supplied with power by the commercial power source 55. Magnetic cores 29*a*, 29*b* and 29*c* of the first to third induction heating coils 27*a*, 27*b* and 27*c* are substantially coaxial with the heat roller 22. The magnetic cores 29*a*, 29*b* and 29*c* have magnetic shielding members 30*a*, 30*b* and 30*c* protruding on both sides of them, and thus can further concentrate the magnetic fluxes onto the heat roller 22. The first induction heating coil 27*a* has a length of 200 mm and heats a central area of the heat roller 22. The second and third induction heating coils 27*b* and 27*c* are arranged to both sides of the first induction heating coil 27*a*. The second and third induction heating coils 27*b* and 27*c* are connected in series and are driven under the same control. The first to third induction heating coils 27*a*, 27*b* and 27*c* heat the heat roller 22 across its total length of 320 mm. The first induction heating coil 27*a*, and the second and third induction heating coils 27*b* and 27*c* are caused to alternately make outputs in a switching manner, and each of them is set to be capable of outputting a maximum of 1500 W.

As a high-frequency current is applied, the induction heating coil 27 generates a magnetic flux. This magnetic flux generates an eddy-current in the heat roller 22 in order to prevent a change in the magnetic field. This eddy-current and the resistance of the heat roller 22 generate Joule heat in the metal conductive layer 22*d*, and the heat roller 22 is heated.

For the induction heating coil 27, a litz wire formed by twisting plural copper wires, each having a diameter of 0.1 to 0.5 mm, is used. As an insulating material for the copper wires, heat-resistant polyamideimide is used. The electric wire and insulating material are not limited to these and the wire diameter is arbitrary. The induction heating coil 27 has Litz wires wound on the magnetic cores 29*a*, 29*b* and 29*c*. The distance between the induction heating coil 27 and the heat roller 22 is not limited to 3 mm. As long as it is within the range of approximately 1 to 5 mm, the heat roller 22 can be efficiently heated.

The first thermistor 33*a* detects the temperature of the central part of the heat roller 22 heated by the first induction heating coil 27*a*. The second thermistor 33*b* detects the temperature of the heat roller 22 heated by the second induction heating coil 27*b*. The third thermistor 33*c* detects the temperature of the heat roller 22 heated by the third induction heating coil 27*c*.

Figure 4:
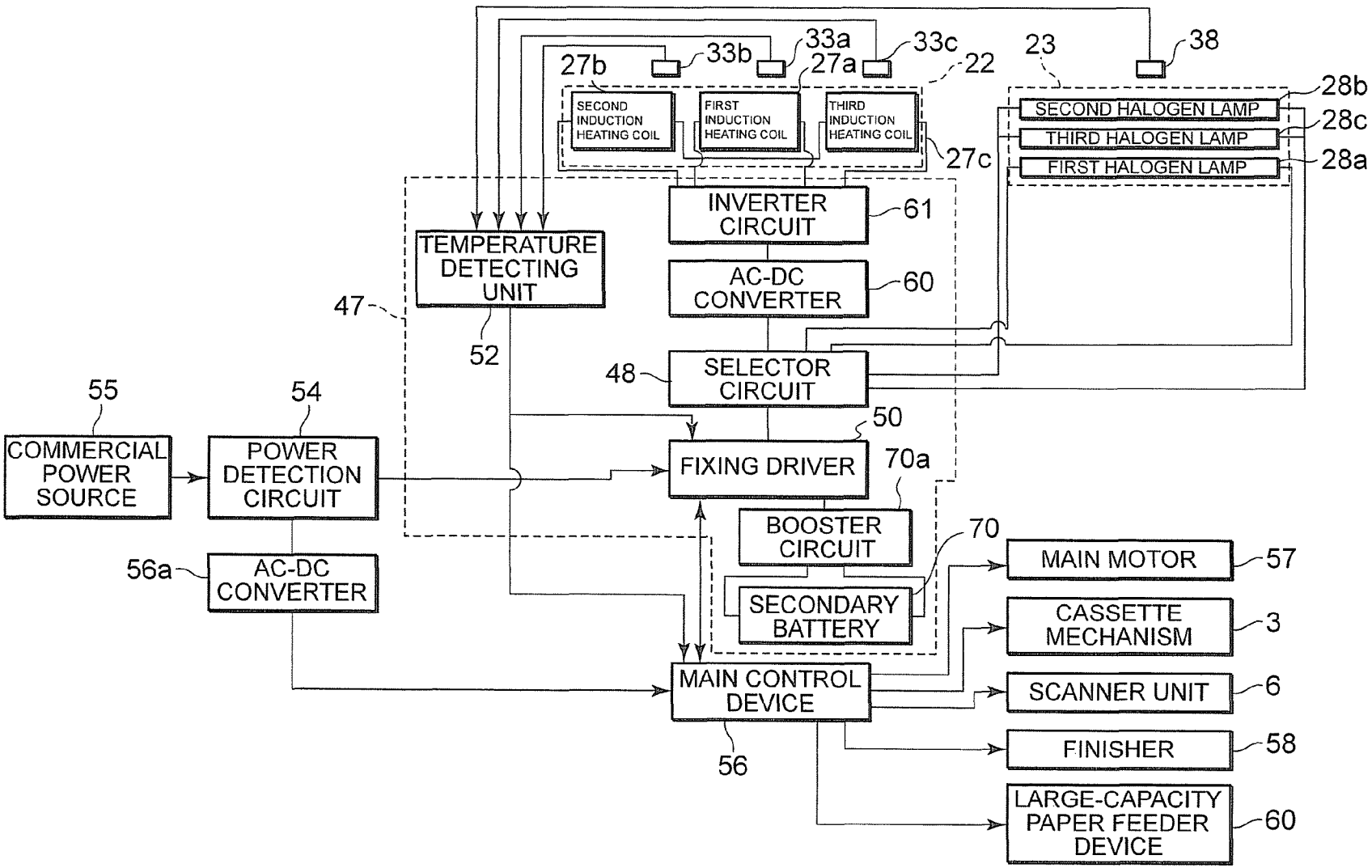
FIG. 4 is a block diagram showing a control unit of the fixing device according to the first embodiment of the invention.

Next, a control unit 47, which is a control unit of the fixing device 11, will be described with reference to the block diagram of FIG. 4. The control unit 47 controls power supply to the induction heating coil 27 that heats the heat roller 22, and to the first halogen lamp heater 28*a* that heats the press roller. The induction heating coil 27 is supplied variably with a high-frequency output (current and voltage) by an inverter circuit 61 of the control unit 47. The first halogen lamp heater 28*a* can be supplied with power of 300 W by the control unit 47. Moreover, the second and third halogen lamp heaters 28*b* and 28*c* can be supplied respectively with power of 500 W and 700 W by the control unit 47.

The control unit 47 has a selector circuit 48 that enables supply of power to the first induction heating coil 27*a* or the second and third induction heating coils 27*b* and 27*c* and that also enables supply of power to the first to third halogen lamp heaters 28*a*, 28*b* and 28*c*, and a fixing driver 50 that supplies a control signal to the selector circuit 48. The fixing driver 50 can be supplied with power from the commercial power source 55 and power from the secondary power source 70. The power from the secondary power source 70 is raised to a required voltage by a booster circuit 70*a* and then inputted to the fixing driver 50. The selector circuit 48 is driven to supply the power from the commercial power source 55 to the induction heating coil 27 and the first halogen lamp heater 28*a*. The selector circuit is driven to supply the power from the secondary battery 70 to the second and third halogen lamp heaters 28*b* and 28*c*.

The control unit 47 further has a temperature detecting unit 52 connected to the first to third thermistors 33*a* to 33*c* that detect the temperature of the heat roller 22 and to the fourth thermistor 38 that detects the temperature of the press roller 23.

The heating temperature of the heat roller 22 can be adjusted as the electrical quantity outputted from the selector circuit 48 to the first to third induction heating coils 27*a* to 27*c* is controlled in accordance with the result of the detection by the first to third thermistors 33*a* to 33*c* and the fourth thermistor 38. The heating temperature of the press roller 23 can be adjusted as the output to the first to third halogen lamp heaters 28*a*, 28*b* and 28*c* is switched and controlled via the selector circuit 48.

The power supplied to the first to third induction heating coils 27*a* to 27*c* and the first halogen lamp heater 28 is constantly monitored by, for example, a power detection circuit 54. The result of monitoring by the power detection circuit 54 is fed back to the fixing driver 50 at a predetermined timing. The output of the power detection circuit 54 is also converted to a direct current by an AC-DC converter 56*a* and inputted also to a main control device 56 of the color image forming apparatus 1.

The main control device 56 controls a main motor 57, the cassette mechanism 3 and the scanner unit 6 of the color image forming apparatus 1. Additionally, in the case where a finisher 58 or a large-capacity paper feeder device 60 is provided as an option, the main control device 56 controls the finisher 58 or the large-capacity paper feeder device 60. The power consumption of the main motor 57, the paper feeder device 3 and the scanner 4 of the color image forming apparatus 1 is, for example, approximately 200 W. The power consumption of the finisher 58 is, for example, approximately 100 W. The power consumption of the large-capacity paper feeder device 60 is, for example, approximately 100 W.

In the control unit 47, the power detection circuit 54 monitors the power consumption of the color image forming apparatus 1 including the fixing device 11 so that it will not exceed a prescribed power value. That is, in the case where a commercial power is used, the prescribed power value that can be used in total by the color image forming apparatus 1 is limited to 1500 W. Therefore, the power detection circuit 54 monitors the power consumption so that the quantity of power consumption available to the fixing device 11 will be, at its maximum, the remaining electrical quantity calculated by subtracting the electrical quantity used for the driving source such as the main motor 57 and the electrical quantity used for an optional function such as the finisher 58 from 1500 W.

The power detection circuit 54 finds the power consumption to be used for the units other than the fixing device 11, such as the main motor 57 or an optional function, by integrating the input current and voltage flowing into each mechanism. However, the control unit 47 enables supply of power to the fixing device 11 from the secondary battery, separately from the commercial power source 55.

Next, variable control of power supplied to the first to third induction heating coils 27*a* to 27*c* and the first to third halogen lamp heaters 28*a*, 28*b* and 28*c* at the time of a copy operation in the color image forming apparatus 1 will be described. In this embodiment, a warming-up operation is carried out every time a copy operation is carried out.

(1) Warming-Up Mode

When the power source is turned on for a copy operation, the warming-up mode is started. In the warming-up mode, power is supplied to the first to third induction heating coils 27*a* to 27*c* and the first to third halogen lamp heaters 28*a*, 28*b* and 28*c*, for example, to set the surface temperature of the heat roller 22 at 160° C. and the surface temperature of the press roller 23 at 130° C.

In the warming-up mode, the maximum electrical quantity that can be supplied to the fixing device 11 by the commercial power source 55 is 1300 W, which is acquired by subtracting the power consumption of 200 W required for the main motor 57, the paper feeder device 3, the scanner 4 and the like, from the prescribed power value of 1500 W of the commercial power source 55. On the other hand, the secondary battery 70 is capable of supplying power to the second and third halogen lamp heaters 28*b* and 28*c* for a time corresponding to the charging quantity.

Therefore, in the warming-up mode, the heat roller 22 and the press roller 23 are heated to the set temperatures as fast as possible by using the secondary battery 70. That is, since the commercial power source 55 needs not be used for heating the side of the press roller 23, the commercial power source 55 supplies to the first to third induction heating coils 27*a* to 27*c* on the side of the heat roller 22 with all the maximum power of 1300 W that can be supplied to the fixing device 11. At the same time, by the secondary battery 70, the second halogen lamp heater 28*b* is supplied with 500 W and the third halogen lamp heater 28*c* is supplied with 1000 W.

The maximum electrical quantity that can be supplied to the fixing device 11 in the warming-up mode is stored, for example, as data in a memory or the like of the main control device 56. Referring to this data, the power detection circuit 54 calculates the power to be supplied to the heat roller 22 or the press roller 23.

Under the above heating conditions, the heat roller 22 reaches the warming-up temperature of 160° C. from 25° C. in about 15 seconds. Also, the press roller 23 reaches the warming-up temperature of 130° C. from 25° C. in about 15 seconds, and the fixing device 11 enters the ready state. By the first to third thermistors 33*a* to 33*c* and the fourth thermistor 38, it is detected that the heat roller 22 or the press roller 23 has reached the warming-up temperature. Here, the charging quantity of the secondary power source 70 can supply power for approximately 5 minutes at 1300 W. Therefore, there is no risk of total discharge and inability to supply power before the end of warming-up.

As a result, the warming-up mode is completed in about 15 seconds after the power source is turned on. When the press roller 23 has reached the warming-up temperature before the heat roller 22 as the total power of 1500 W is supplied to the second and third halogen lamp heaters 28*b* and 28*c*, the power supply by the secondary power source 70 is stopped first. Alternatively, the power supply may be controlled by turning off one of the second and third halogen lamp heaters 28*b* and 28*c* during the operation, and so on, so that the heat roller 22 and the press roller 23 reach the warming-up temperatures simultaneously. That is, the power supply in the warming-up mode can be properly adjusted in accordance with the properties of the heat roller 22 or the press roller 23.

In this manner, in the warming-up mode, since the secondary battery 70 is used for the heating power on the side of the press roller 23, the power from the commercial power source 55 can be supplied to the side of the heat roller 22, except for the power required for the main motor 57, the paper feeder device 3, the scanner 4 and the like. This enables shortening of the warming-up time. After the completion of warming-up, the copy mode is immediately started.

(2) Copy Mode

In the copy mode, the surface temperature of the heat roller 22 is maintained at 160±10° C. and the surface temperature of the press roller 23 is maintained at 160±15° C. It is assumed that the color image forming apparatus 1 has, for example, the finisher 58 and the large-capacity paper feeder device 60 as optional functions. In this case, in the copy mode, the maximum electrical quantity that can be supplied to the fixing device 11 is 1100 W, which is acquired by subtracting the power consumption of 200 W required for the main motor 57, the paper feeder 3, the scanner 4 and the like, and the power consumption of 200 W required for the finisher 58 and the large-capacity paper feeder device 60 from the prescribed power value of 1500 W of the commercial power source 55. This 1100 W is distributed to the heat roller 22 and the press roller 23. However, in the case of distributing the power, the side of the heat roller 22 is given priority. That is, the power supply to the first to third induction heating coils 27*a* to 27*c* on the side of the heat roller 22 and the first halogen lamp heater 28*a* on the side of the press roller 23 is variably controlled to optimize the power supply. Also the maximum electrical quantity that can be supplied to the fixing device 11 in the copy mode is stored as data in the memory or the like of the main control device 56. The maximum electrical quantity that can be supplied to the fixing device 11 in the copy mode varies depending on the presence or absence of optional functions of the color image forming apparatus 1.

For example, in the case of fixation on a sheet paper P of JIS standard B4 size, the first to third induction heating coils 27*a* to 27*c* are supplied with 800 W, and the first halogen lamp heater 28*a* is supplied with 300 W. While copying is carried out, the power supply is variably controlled in accordance with the result of temperature detection by the first to third thermistors 33*a* to 33*c* or the fourth thermistor 38. If the electrical quantity to be supplied to the first to third induction heating coils 27*a* to 27*c* on the side of the heat roller 22 needs to be increased, the first halogen lamp heater 28*a* on the side of the press roller 23 is turned off and the second halogen lamp heater 28*b* is turned on by using the secondary battery 70. The power of 300 W of this first halogen lamp heater 28*a* is added to the first to third induction heating coils 27*a* to 27*c* on the side of the heat roller 22, thus increasing the electrical quantity.

In this case, the first halogen lamp heater 28*a* is turned off and the third halogen lamp heater 28*c* may be turned on by using the secondary battery 70. However, to securely prevent a temperature ripple on the side of the press roller 23, it is preferred that the second halogen lamp heater 28*b* is used, in which case the variance in power supply due to the switching is 500 W or less. Particularly, in the state where the color image forming apparatus 1 has been stopped for a long time, all the components of the fixing device 11 are cooled. In this state, energy supply is insufficient if heating is carried out at 1100 W from the commercial power source 55 alone. Thus, it is preferred that the halogen lamp heater 38 on the side of the press roller 23 is driven at approximately 500 W by using the secondary battery 70 for approximately 3 minutes.

Similarly, for example, in the case of fixation on a sheet paper P of JIS standard A4 size, first, only the first induction heating coil 27*a* is supplied with 800 W and the first halogen lamp heater 28*a* is supplied with 300 W. While copying is carried out, the power supply is variably controlled in accordance with the result of temperature detection by the first thermistor 33*a* or the fourth thermistor 38. On the side of the heat roller 22, the power supplied to the first induction heating coil 27*a* is variably controlled. On the side of the press roller 23, the power supply is variably controlled by switching the power supply from the first halogen lamp heater 28*a* to the second halogen lamp heater 28*b*, and so on.

Therefore, also in the copy mode, the power supply to the side of the heat roller 22 and the side of the press roller 23 can be variably controlled. The variable control of the power supply enables proper adjustment of the temperature of the heat roller 22 or the press roller 23 during the copy mode. Therefore, the temperature of the heat roller 22 or the press roller 23 can be controlled in detail, and even for a full-color toner image with a thick layer, the toner layer can be melt constantly in the uniform state. As a result, the color difference for each copy can be reduced and a fixed color image of stable image quality can be provided.

The quantity of variance of the power supply to the first to third induction heating coils 27*a* to 27*c* is arbitrary. However, to prevent a temperature ripple, a proper variance of the power supply to the first to third induction heating coils 27*a* to 27*c* is 500 W or less. After the copying has ended, the heating of the fixing device 11 is stopped. During the non-copying time, the secondary battery 70 is charged. After the charging is completed, the power source may be turned off.

After that, if a copy operation is requested, the heat roller 22 and the press roller 23 are heated to their respective warming-up temperatures in the above warming-up mode, and then copying is carried out. However, in a time zone when the color image forming apparatus 1 is frequently used, the heat roller 22 and the press roller 23 are often at higher temperatures than room temperature and there is a high possibility that the warming-up time is further reduced.

According to this first embodiment, in each mode of the fixing device 11 of the color image forming apparatus 1, the power supplied to the first to third induction heating coils 27*a* to 27*c* or the first to third halogen lamp heaters 28*a*, 28*b* and 28*c* is variably controlled in accordance with the temperature of the heat roller 22 and the press roller 23. Moreover, the secondary battery 70 is used when necessary, in order to heat the press roller 23. Therefore, in the warming-up mode, as all the power supply to the side of the press roller 23 can be provided by the secondary battery, the power supplied to the side of the heat roller 22 can be increased and the warming-up time can be shortened, thus improving convenience for the user.

Also, in the copy mode, detail temperature control of the heat roller 22 or the press roller 23 enables melting of a thick toner layer in a uniform state, and the color difference for each copy is reduced to provide a fixed color image of uniform image quality. Moreover, since the warming-up time can be shortened, the user has to wait only for a short time even if the fixing device 11 is heated only when carrying out a copy operation. Therefore, in the non-copying time, the power supply to the heat roller 22 and the press roller 23 can be stopped, and energy saving can be realized without lowering the convenience for the user.

Next, a second embodiment of the invention will be described. In this second embodiment, the power of the secondary battery in the above first embodiment can be supplied to the heat roller side, and the other parts are similar to those of the first embodiment. Therefore, in this second embodiment, the same configuration as the configuration described in the above first embodiment is denoted by the same reference numerals and will not be described further in detail.

Figure 5:
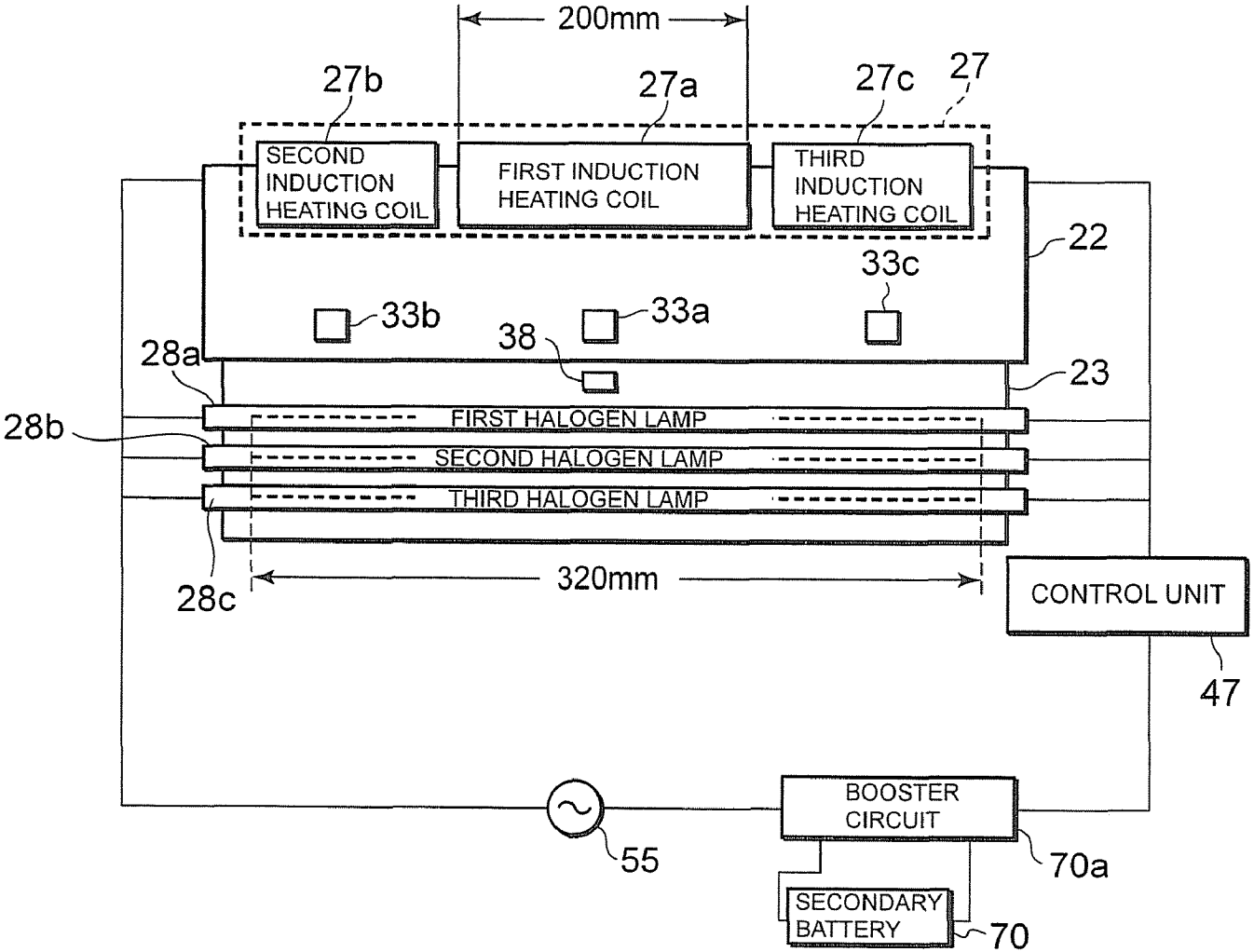
FIG. 5 is an explanatory view showing a fixing device according to a second embodiment of the invention, as viewed from its lateral side.

In the second embodiment, as shown in FIG. 5, induction heating coils 27 and first to third halogen lamp heaters 28*a*, 28*b* and 28*c* can be supplied with the power from a commercial power source 55 and the power from a secondary battery 70. Whether the commercial power source 55 or the secondary battery 70 should be used to supply power to the induction heating coils 27 or the first to third halogen lamp heaters 28*a*, 28*b* and 28*c*, and what electrical quantity should be used, are controlled by a driving unit 50. The controlled predetermined power is supplied to the induction heating coils 27 or the first to third halogen lamp heaters 28*a*, 28*b* and 28*c* via a switching circuit 48.

Next, variable control of the power supplied to the first to third induction heating coils 27*a* to 27*c* and the first to third halogen lamp heaters 28*a*, 28*b* and 28*c* will be described.

(3) Warming-Up Mode

In the warming-up mode, the maximum power that can be supplied to the heat roller 22 by the commercial power source 55 is 1300 W. However, for example, in the case where the warming-up time on the side of the heat roller 22 is to be shortened further, the induction heating coils 27 are supplied with power of 300 to 500 W by the secondary battery 70 in addition to 1300 W of the commercial power source 55. The voltage of the secondary battery 70 is raised in accordance with the specifications of the commercial power source. Thus, the first to third induction heating coils 27*a* to 27*c* are supplied with, for example, power of 1600 to 1800 W of a total voltage of 141 V.

Also, on the side of the press roller 23, the second and third halogen lamp heaters 28*b* and 28*c* are supplied with a total of 1000 W by the secondary battery 70.

Under the above heating conditions, the heat roller 22 reaches the warming-up temperature of 160° C. from 25° C. in about 15 seconds. Also, the press roller 23 reaches the warming-up temperature of 130° C. from 25° C. in about 15 seconds, and the fixing device 11 enters the ready state. As a result, the warming-up mode is completed in about 15 seconds after the power source is turned on.

If the first to third thermistors 33*a* to 33*c* and the fourth thermistor 38 detect that the heat roller 22 has reached the warming-up temperature first, the power supply to the first to third induction heating coils 27*a* to 27*c* is stopped. At the same time, the power supply may be controlled by supplying the power to the side of the press roller 23 by the commercial power source 55 and the secondary battery 70 to increase the heating speed, and so on. That is, the power supply from both the commercial power source 55 and the secondary battery 70 can be properly adjusted in accordance with the properties of the heat roller 22 or the press roller 23.

In this manner, in the warming-up mode, the use of the secondary battery 70 enables shortening of the warming-up time. After the completion of warming-up, the copy mode is immediately started.

(4) Copy Mode

In the copy mode, since power is supplied to optional functions, the maximum electrical quantity that can be supplied to the fixing device 11 by the commercial power source 55 is 1100 W. Within this range, the power supply to the first to third induction heating coils 27*a* to 27*c* on the side of the heat roller 22 and the first halogen lamp heater 28*a* on the side of the press roller 23 is variably controlled to optimize the power supply.

For example, in the case of fixation on a sheet paper P of JIS standard A3 size, the first to third induction heating coils 27*a* to 27*c* are supplied with 800 W, and the first halogen lamp heater 28*a* is supplied with 300 W. While copying is carried out, the power supply is variably controlled in accordance with the result of temperature detection by the first to third thermistors 33*a* to 33*c* or the fourth thermistor 38. If the electrical quantity to be supplied to the side of the heat roller 22 needs to be increased, the power source on the side of the press roller 23 may be switched from the commercial power source 55 to the secondary battery 70, thus increasing the electrical quantity on the heat roller 22. Alternatively, the power from the secondary battery 70 may be added to the power to the side of the heat roller 22 from the commercial power source 55, while the first halogen lamp heater 28*a* on the side of the press roller 23 is kept supplied with 300 W by commercial power 23.

Thus, also in the copy mode, the power supply to the side of the heat roller 22 and the side of the press roller 23 can be variably controlled. The variable control of the power supply enables proper adjustment of the temperature of the heat roller 22 or the press roller 23 during the copy mode. Therefore, the temperature of the heat roller 22 or the press roller 23 can be controlled in detail, and even for a full-color toner image with a thick layer, the toner layer can be melt constantly in the uniform state. As a result, the color difference for each copy can be reduced and a fixed color image of stable image quality can be provided.

According to this second embodiment, in each mode of the fixing device 11 of the color image forming apparatus 1, the power supplied to the first to third induction heating coils 27*a* to 27*c* or the first to third halogen lamp heaters 28*a*, 28*b* and 28*c* is variably controlled in accordance with the temperature of the heat roller 22 and the press roller 23. Moreover, the secondary battery 70 is used when necessary, in order to heat the heat roller 22 and the press roller 23. That is, both in the warming-up mode and in the copy mode, the power supply can be increased when necessary. Thus, the warming-up time can be shortened and the convenience for the user can be improved. Also, in the copy mode, detail temperature control of the heat roller 22 or the press roller 23 enables melting of a thick toner layer in a uniform state, and the color difference for each copy is reduced to provide a fixed color image of uniform image quality. Moreover, since the warming-up time can be shortened, the user has to wait only for a short time, even if the power supply to the heat roller 22 and the press roller 23 is stopped in the non-copying time and the warming-up operation is carried out every time a copy operation is carried out. Thus, energy saving can be realized without lowering the convenience for the user.

This invention is not limited to the above embodiment and various changes can be made within the scope of the invention. For example, the shape and structure of the image-side rotating member or the non-image-side rotating member are not limited and they may be endless belts or the like. The first or second heating source is not limited, either. For example, as the first heating source, the structure, heating area and the like of the induction heating coil are not limited. Also, instead of the induction heating coil, the first heating source may be plural halogen lamp heaters with different quantities of power consumption and heating areas, provided within the image-side rotating member. In an arbitrary operation mode, the temperature of the image-side rotating member can also be properly adjusted by variable control of the power supply to the image-side rotating member to switch the halogen lamp heater to be used. Similarly, an induction heating coil, infrared heater or the like may be used as the second heating source.

What is claimed is:

1. A fixing device for an image forming apparatus comprising:

image-side rotating means for heating a side of a fixing target medium on which a toner image is formed;

non-image-side rotating means for nipping and carrying the fixing target medium into a predetermined direction together with the image-side rotating means, and contacting a side of the fixing target medium on which the toner image is not formed;

first heating source means for heating the image-side rotating means;

second heating source means for heating the non-image-side rotating means;

commercial power source means for supplying power to the first heating means and the second heating means;

auxiliary power source means for supplying power at least to the second heating means; and control means for variably controlling power to be supplied to the first heating source means or the second heating source means from the commercial power source means and/or the auxiliary power source means while the image-side rotating means is carrying out an arbitrary operation mode.

2. The fixing device for an image forming apparatus according to claim 1, wherein the control means carries out control so that a sum value of the power to be supplied to the first heating source means and the power to be supplied to the second heating source means from the commercial power source means does not exceed a prescribed power value.

3. The fixing device for an image forming apparatus according to claim 2, wherein the power to be supplied to the first heating source means is given priority.

4. The fixing device for an image forming apparatus according to claim 2, wherein a maximum value of the sum value is set for each operation mode of the image-side rotating means.

5. The fixing device for an image forming apparatus according to claim 1, further comprising first temperature detecting means for detecting surface temperature of the image-side rotating means and second temperature detecting means for detecting surface temperature of the non-image-side rotating means, wherein the control means varies the power to be supplied to the first heating source means and the power to be supplied to the second heating source means in accordance with a first detection result by the first temperature detecting means and a second detection result by the second temperature detecting means.

6. The fixing device for an image forming apparatus according to claim 1, wherein the auxiliary power source means can supply power to both the first heating source means and the second heating source means.

7. A fixing device for an image forming apparatus comprising:

an image-side rotating member;

a non-image-side rotating member configured to nip and carry a fixing target medium having a toner image thereon into a predetermined direction together with the image-side rotating member;

a first heating source configured to heat the image-side rotating member;

a second heating source configured to heat the non-image-side rotating member;

a commercial power source configured to supply power to the first heating source and the second heating source;

an auxiliary power source configured to supply power at least to the second heating source; and a control unit configured to variably control power to be supplied to the first heating source or the second heating source from the commercial power source and/or the auxiliary power source while the image-side rotating member is carrying out an arbitrary operation mode.

8. The fixing device for an image forming apparatus according to claim 7, wherein the first heating source is an induction heating coil or plural halogen lamp heaters.

9. The fixing device for an image forming apparatus according to claim 7, wherein the second heating source is an induction heating coil, plural halogen lamp heaters, or plural infrared heaters.

10. The fixing device for an image forming apparatus according to claim 7, wherein the control unit carries out control so that a sum value of the power to be supplied to the first heating source and the power to be supplied to the second heating source does not exceed a prescribed power value of the commercial power source.

11. The fixing device for an image forming apparatus according to claim 10, wherein the power to be supplied to the first heating source is given priority.

12. The fixing device for an image forming apparatus according to claim 10, wherein the control unit variably controls the power supplied to the second heating source from the auxiliary power source while the image-side rotating member is carrying out an arbitrary operation mode.

13. The fixing device for an image forming apparatus according to claim 12, further comprising a first temperature detecting member for the image-side rotating member and a second temperature detecting member for the non-image-side rotating member, wherein the control unit variably controls the power to be supplied to the first heating source and the power to be supplied to the second heating source in accordance with a first detection result by the first temperature detecting member and a second detection result by the second temperature detecting member.

14. The fixing device for an image forming apparatus according to claim 7, wherein a maximum value of the sum value is set for each operation mode of the image-side rotating member.

15. The fixing device for an image forming apparatus according to claim 7, wherein the auxiliary power source includes a secondary battery.

16. The fixing device for an image forming apparatus according to claim 7, wherein the auxiliary power source can supply power to both the first heating source and the second heating source.

17. A control method of a fixing device for an image forming apparatus comprising:

nipping and carrying a fixing target medium having a toner image thereon into a predetermined direction by an image-side rotating member heated by a first heating source which is supplied a variably controlled power in accordance with a first detection result by a first temperature detecting member, and a non-image-side rotating member heated by a second heating source which is supplied a variably controlled power in accordance with a second detection result by a second temperature detecting member;

controlling a first power to be supplied to the first heating source by a commercial power source while the image-side rotating member is carrying out a first operation mode;

controlling a first auxiliary power to be supplied to the second heating source by an auxiliary power source while the image-side rotating member is carrying out the first operation mode;

controlling a second power to be supplied to the first heating source by the commercial power source while the image-side rotating member is carrying out a second operation mode; and controlling a second auxiliary power to be supplied to the second heating source by the auxiliary power source while the image-side rotating member is carrying out the second operation mode.

* * * * *